United States Patent [19]

Beckerman

[11] 4,188,901

[45] Feb. 19, 1980

[54] LOW BOBBIN THREAD DETECTION SYSTEM

[75] Inventor: Howard L. Beckerman, Red Bank, N.J.

[73] Assignee: The Singer Company, New York, N.Y.

[21] Appl. No.: 6,396

[22] Filed: Jan. 25, 1979

[51] Int. Cl.[2] ..... D05B 69/00; G01B 7/12

[52] U.S. Cl. ..... 112/278; 250/239

[58] Field of Search ..... 112/278, 273; 250/239, 250/237 R; 356/429; 139/273 A; 242/37 R

[56] References Cited

U.S. PATENT DOCUMENTS

| | | | |
|---|---|---|---|
| 1,988,255 | 1/1935 | Soons | 139/273 A |
| 3,082,968 | 3/1963 | Reichelt et al. | 112/278 X |
| 3,599,586 | 8/1971 | Newman | 112/278 |
| 3,845,320 | 10/1974 | Winberg | 139/273 A |
| 4,021,119 | 5/1977 | Stauffer | 250/239 X |

*Primary Examiner*—Peter P. Nerbun

*Attorney, Agent, or Firm*—Robert E. Smith; Edward L. Bell; Michael H. Wallach

[57] ABSTRACT

A low bobbin thread detection system for sewing machines. A light source transmits a beam of light through a pair of passageways contained in the bobbin case and toward a photodetector enclosed in a shield to shelter it from stray light. The light shield contains a pair of spaced apertures whose axes are in optical alignment with the light source and the bobbin case passageways. The thread carrying bobbin lies intermediate the passageways and does not permit the transmission of light from the first to the second passageway while thread remains thereon. When sufficient thread has been consumed from the bobbin, light may pass from the light source to the photodetector. Light which is directed at the shield surrounding the photodetector from any angle other than that coincident with the optical axis formed by the two apertures is blocked from impinging on the photodetector and will not falsely trigger a low bobbin thread alarm.

9 Claims, 5 Drawing Figures

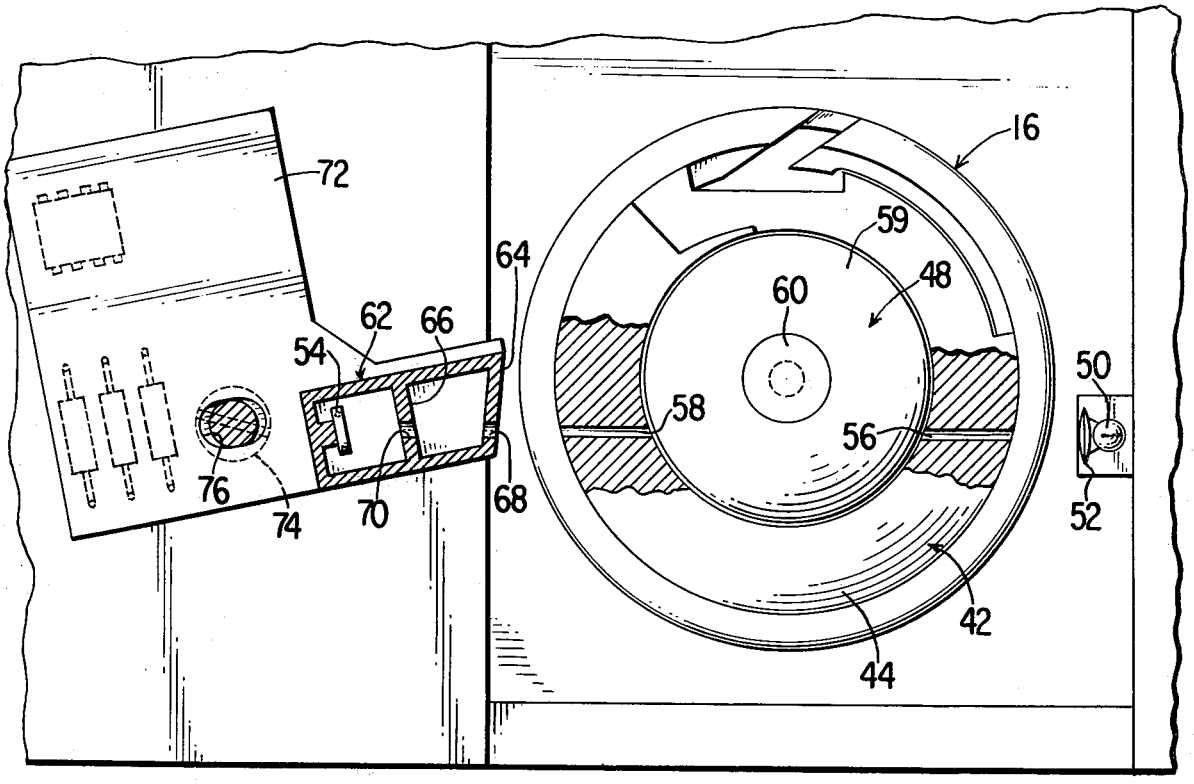
Fig. 2
Fig. 4
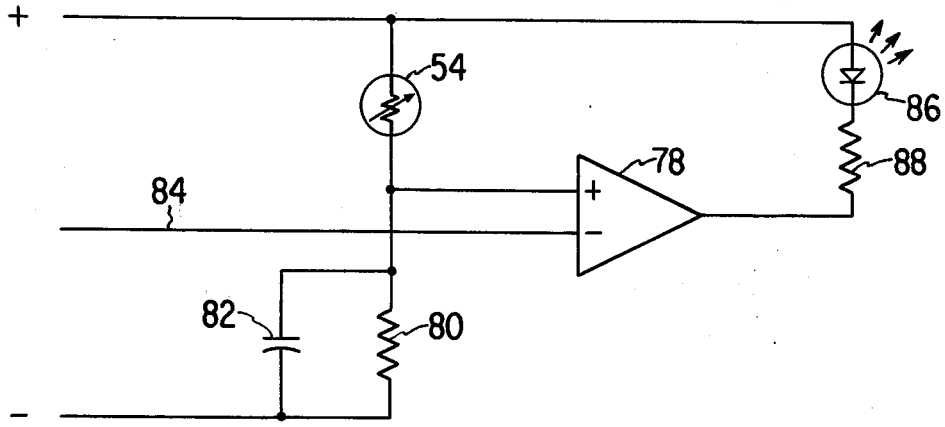
Fig. 5
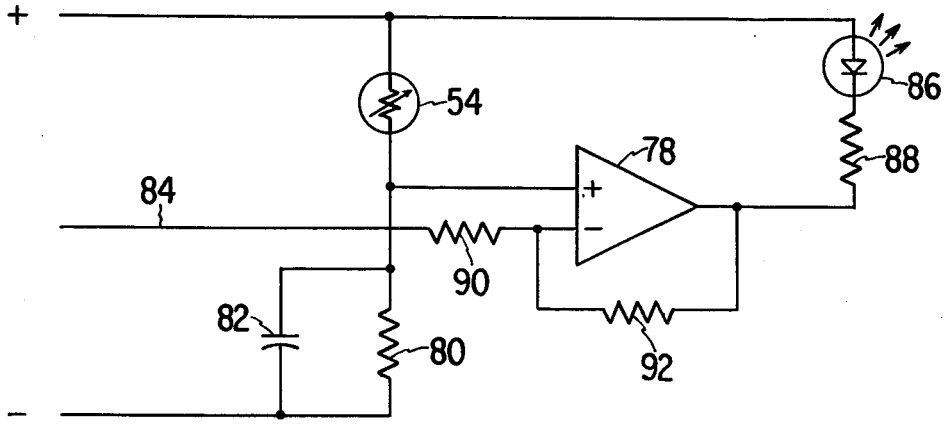

LOW BOBBIN THREAD DETECTION SYSTEM

DESCRIPTION

BACKGROUND OF THE INVENTION

1. Field of the Invention

This disclosure relates to sewing machines in general and more particularly to sewing machines in which it is desirable to have a means for automatically advising the operator of the impending depletion of bobbin thread.

2. Description of the Prior Art

Typical low bobbin thread detection systems which operate from a photodetector sensor are known in the prior art and have frequently been of limited reliability due to the effect of stray light producing erroneous triggering of the low bobbin thread warning alarm. Most attempts to eliminate the effect of stray light from such sources as room lighting and sewing machine-mounted work-guiding lights have been limited to enclosing the loop taker cavity in which the light sensitive photodetector resides with an opaque bed slide and spraying the cavity with a flat black paint treatment to reduce internal reflections from reaching the photodetector. Another problem with some prior known low bobbin thread detector systems which utilize photodetectors is that the photodetector may not be conveniently aligned relative to the optical path during the manufacturing process. Still another problem is that some photodetector systems resort to complex electronic filter circuits to reduce the effects of stray light impinging on the photodetector. Still other prior known low bobbin thread detection systems have required the use of a specially designed bobbin which necessitated the production and stocking of more than one type of bobbin by sewing machine manufacturers.

SUMMARY OF THE INVENTION

One object of this invention is to provide a low bobbin thread detection system for sewing machines which is immune to stray light in the vicinity of the photodetector.

Another object is to provide a low bobbin thread detection system which may be easily assembled from a minimum number of components.

Still another object is to provide a system which may be used with bobbins of conventional design.

The above and other objects of this invention are carried out by mounting a light source on one side of the bobbin case and providing an optical path which passes through both the bobbin case and the bobbin contained therein. A photodetector is mounted on the side of the loop taker distant from the light source and along the optical axis of the path which passes through the bobbin case so that the photodetector and light source may be optically aligned one with the other. Surrounding the photodetector is an opaque shield which has two walls with each wall having an aperture spaced apart one from the other through which light may pass. The optical axes of the apertures are aligned one with the other and with the optical axis of the path passing between the bobbin case and the light source. When a sufficient quantity of thread is removed from the bobbin during the sewing process to permit light to traverse the optical path between the light source and the photodetector, an electronic circuit to which the photodetector is connected is activated, which operates a signalling device to warn the sewing machine operator of the impending depletion of bobbin thread. The photodetector is immune to false triggering due to stray light by virtue of the opaque shield which surrounds it. The photodetector will only be activated by light which enters along an optical path coincident with the optical axes of the two spaced apertures in the shield and the photodetector. All other light is blocked from impinging on the photodetector.

BRIEF DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction, and advantages of it when read in conjunction with the accompanying drawings in which:

FIG. 2 is a top sectional view taken along line 2—2 of FIG. 1 showing the optical path connecting the components of the low bobbin thread detection system;

Fig. 4 is an electronic schematic diagram of a preferred embodiment of a circuit which may be used to activate a low bobbin thread warning device; and FIG. 5 is an electronic schematic diagram of an alternate circuit which may be used to turn on a low bobbin thread warning device.

DETAILED DESCRIPTION OF THE PREFERRED EMBODIMENT

Figure 1:
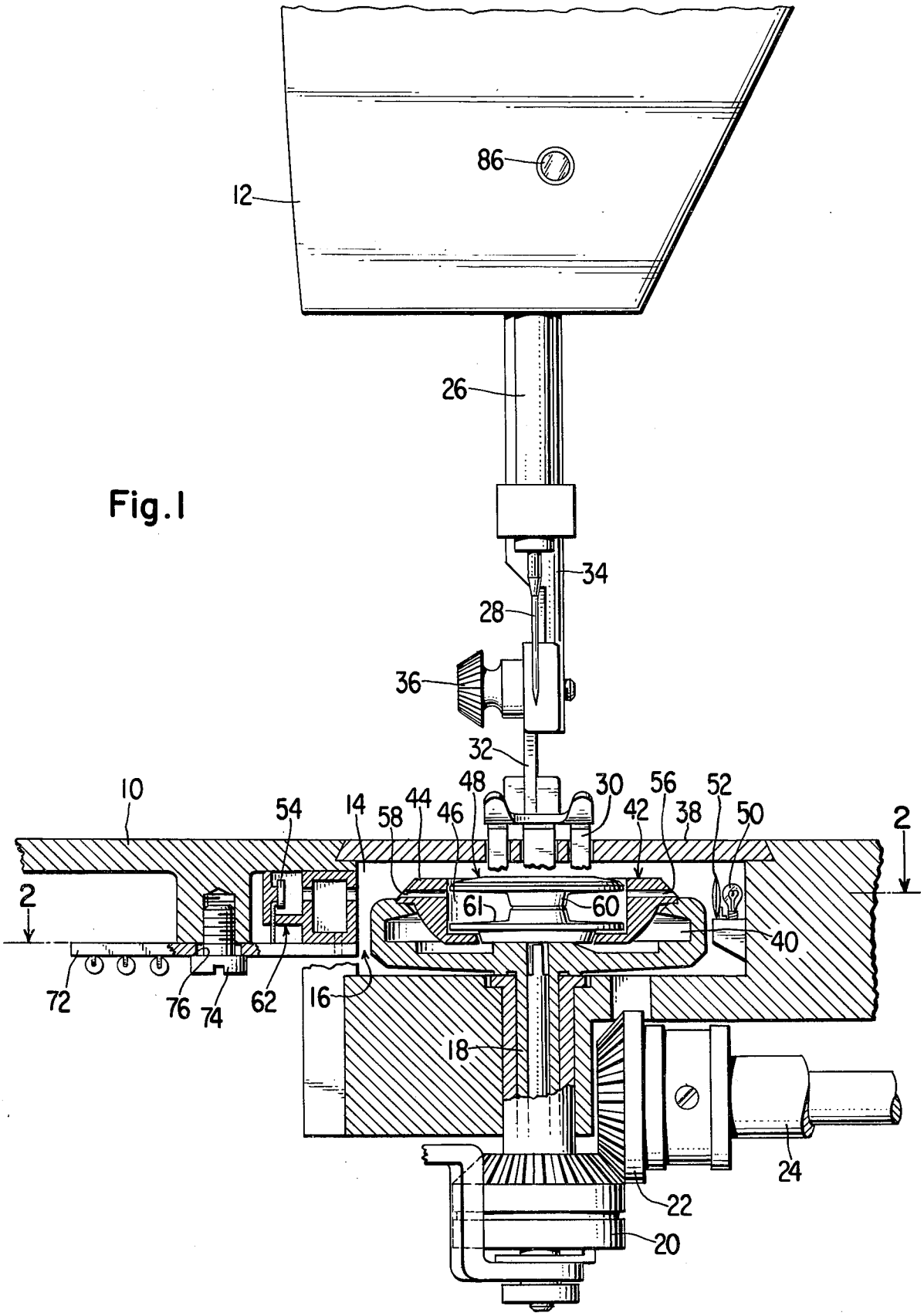
FIG. 1 is a front view partially in section of a portion of a sewing machine having a low bobbin thread detection system constructed in accordance with the teachings of this invention.

Referring to the drawings, FIG. 1 shows a portion of a sewing machine having a bed 10 and a sewing head 12 overhanging the bed 10. The bed 10 contains a cavity 14 in which a loop taker 16 is rotatably carried on one extremity of a shaft 18 having a vertical axis. Fastened to the extremity of the shaft 18 opposite the loop taker 16 is a bevel gear 20 which is driven by a second bevel gear 22 fastened to a drive shaft, a fragment of which is shown at 24. The loop taker 16 rotates in timed synchronization to the reciprocation of a needle bar 26 which is reciprocatorily carried in the sewing head 12. Fastened to the needle bar 26 is a needle 28 which is driven in endwise reciprocatory motion through a fabric supported on the sewing machine bed 10. The fabric may be moved along a line of feed on the bed 10 by the compound motion of a feed dog, a fragment of which appears at 30, which acts against the thrust of a presser foot 32 which is fastened to a presser bar 34 by a presser clamp 36. The feed dog 30 is driven in timed relation to the motion of the needle bar 26 by a mechanism which need not be understood for a full and complete understanding of the present invention. Preferably a slide plate 38 encloses a portion of the cavity 14. A throat plate (not shown) encloses the remainder of the cavity 14 and supports the fabric against the thrust of the needle 28.

The loop taker 16 contains a cavity 40 in which is supported a bobbin case 42 whose periphery is defined by a wall 44. The bobbin case 42 is restrained from partaking of motion with the loop taker by means which are well known in the prior art. See for example, the U.S. patent application No. 4,117, of W. Herron et al., which was filed on Jan. 17, 1979, the teachings of which are incorporated herein by reference. Contained within a cavity 46 in the bobbin case 42 is a bobbin 48 which may be filled with a quantity of thread for concatenation with thread carried by the needle 28 during the well known process of forming lockstitches. The bobbin 48 is freely rotatable within the bobbin case 42 in response to the withdrawal of thread therefrom during the sewing process.

It will be readily appreciated by one skilled in the art of sewing that it is inconvenient to exhaust the supply of bobbin thread while in the middle of a sewing project. Inasmuch as the bobbin is located within the sewing machine bed 10 over which is draped the garment or fabric being sewn, it will be appreciated that it is difficult to readily observe the quantity of thread remaining on the bobbin while carrying out the sewing process. To the end of alleviating the problems attendant with observing the quantity of bobbin thread, a mechanism which will signal the sewing machine operator to the approaching exhaustion of bobbin thread will find particular utility in minimizing the inconvenience of running out of bobbin thread during a sewing project.

The low bobbin thread detection system disclosed herein is carried out by placing a light source consisting (as but one example) of an electrically operated bulb 50 and a collimating lens 52 on one side of the loop taker 16 and a light sensitive photodetector 54 on the opposite side of the loop taker 16 distant from the light source,. FIG. 2 best shows that a first horizontal passageway 56 and a second horizontal passageway 58 are formed in the wall 44 of the bobbin case 42 so that the optical axes of the of the passageways 56 and 58 form an optical path which permits light radiated from the bulb 50 to pass through the bobbin case 42 and impinge on the photodetector 54. It may be seen from FIG. 2 that the optical axis formed by the passageways 56 and 58 are arranged in an optical alignment which traverses exteriorly of a central core 60 which is arranged between a pair of end flanges 59 and 61 at the center of the bobbin 48 so that when thread is wrapped around the core 60, light will not pass from the passageway 56 to the passageway 58. However, upon the consumption of a quantity of bobbin thread sufficient to expose the passageway 58 to transmission of light from the passageway 56, light will be allowed to pass therethrough and will illuminate the photodetector 54. The position of the passageways 56 and 58 relative to the core 60 is chosen so that when light traverses the path from the passageway 56 to the passageway 58, a sufficient quantity of bobbin thread will remain on the core 60 to permit the operator to discover the impending depletion of thread before fully exhausting the supply of bobbin thread.

Figure 3:
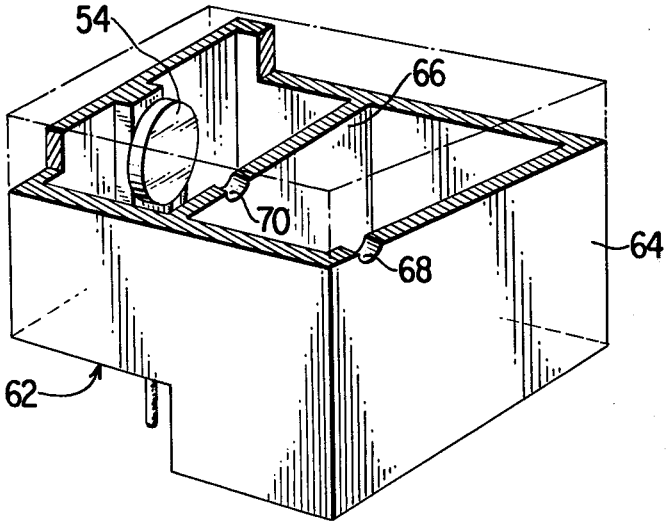
FIG. 3 is a perspective view of the light shield which surrounds the photodetector.

Stray light which may be present in the vicinity of the photodetector 54 is precluded from impinging thereon and hence providing an erroneous indication of the impending exhaustion of bobbin thread by enclosing the photodetector 54 within a photodetector shielding means shown generally at 62 in FIG. 2. It will best be appreciated from a review of FIG. 3 that preferably the shield 62 has an outside wall 64 and an inside wall 66, the inside wall 66 being spaced between the outside wall 64 and the photodetector 54. Preferably, the photodetector 54 is mounted a distance behind the inside wall 66. Preferably, there are formed through the outside wall 64 and the inside wall 66 a pair of spaced apertures, the outside wall 64 containing a first aperture 68 and the inside wall 66 containing a second aperture 70. The cross sectional area of the apertures is chosen so that a sufficient quantity of light will impinge on the photodetector 54 from the light source to cause the activation of a low bobbin thread signalling means. The apertures 68 and 70 have optical axes which are aligned so that they are coincident with the optical axis of the light source and the optical axis of the photodetector 54. Preferably the shield 62 is mounted on a board 72 to which are also fastened the electronic components which control a signalling means for warning the sewing machine operator of the impending depletion of bobbin thread. The board 72 is fastened to the sewing machine bed 10 by a fastener such as the screw 74 which passes through an elongated slot 76 and which constitute a means for aligning the photodetector 54 relative to the optical axes of the passageways 56 and 58 and the light source, by loosening the screw 74 and rotating the board 72 until the proper alignment is obtained.

It will be apparent from a review of FIGS. 1 and 2 that stray light from either the light source 50 or a source external to the loop taker cavity 14 is precluded from impinging on the photodetector 54 since it would be required to enter the shield 62 by passing through both the first aperture 68 and the second aperture 70. Light which enters the first aperture 68 from any direction other than that which is coincident with the optical axes of the passageways 56 and 58 will strike the inside wall 66 and will not pass through the second aperture 70 to reach the photodetector 54.

FIG. 4 shows a preferred embodiment of an electronic circuit which comprises a photodetector analyzing means for triggering a signalling means responsive to the state of the photodetector 54. An operational amplifier 78 is used as a comparator to compare the voltage across the parallel combination of a resistor 80 and a capacitor 82 to a reference voltage on a line 84. When the photodetector 54 is illuminated by light from the bulb 50, its electrical resistance decreases, causing the voltage across the parallel combination of the resistor 80 and the capacitor 82 to increase. When the voltage across the resistor 80 and the capacitor 82 exceeds the reference voltage on the linke 84, the operational amplifier 78 is triggered and turns on the low bobbin thread signalling means shown preferably as a light emitting diode 86. A resistor 88 is placed in series with the diode 86 to limit the current drawn thereby. It is to be understood that the capacitor 82 acts as a filter to preclude the triggering of the operational amplifier 78 by noise produced by the bulb 50, machine vibrations, electrical transients, and the like.

With the electrical configuration shown in FIG. 4, the signalling means 86 will flash each time that the optical path between the bulb 50 and the photodetector 54 is interrupted, as for example, when the bobbin 48 is drawn into the optical path between the aperture 56 and the aperture 58 during the removal of bobbin thread therefrom during the sewing process.

FIG. 5 shows an alternate embodiment of an electronic circuit which may be used to operate a signalling means in response to the depletion of bobbin thread. A resistor 90 and a resistor 92 operate to provide a positive triggering point to the operational amplifier 78 so that when the signalling means 86 is first operated by light impinging on the photodetector 54, the operational amplifier will continue to operate the signalling means 86 irrespective of whether the photodetector 54 is being illuminated by the bulb 50. The signalling means 86 will be extinguished when the bobbin is refilled with thread.

It will be apparent from the foregoing description that the photodetector 54 will be illuminated only when a sufficient quantity of thread has been withdrawn from the bobbin 48 so that an optical path free of any intermediate impediment exists between the passageway 56 and the passageway 58. Illumination of the photodetector 54 will thereafter result in operation of the signalling means 82 by the photodetector analyzing means, thereby mitgating the possibility of the complete exhaustion of bobbin thread by the sewing machine operator while engaged in a sewing project.

From the above detailed description of a preferred embodiment of the invention it will be seen that a novel low bobbin thread detection system is provided which is relatively immune to false indications from stray light leaking into the loop taker cavity. The components of the system are easily constructed and aligned, and provide the sewing machine operator with a positive warning of the impending exhaustion of bobbin thread. While the invention has been described in its preferred embodiment, it will be obvious to those skilled in the art that various changes and modifications may be made therein without departing from the spirit and scope of the invention as set forth in the appended claims.

I claim:

1. In a sewing machine having a bed, a needle reciprocatorily driven toward and away from said bed, said needle carrying a needle thread, a cavity formed in said bed, a loop taker having a vertical axis rotatably journalled in said cavity, said loop taker supporting a bobbin case having a wall, a bobbin contained within said bobbin case and having a central core arranged between a pair of end flanges for accomodating a quantity of bobbin thread for concatenation with the thread carried by said needle, a low bobbin thread detection system characterized by a first passageway and a second passageway formed in said wall of said bobbin case, said first and said second passageways spaced apart one from the other on opposite sides of said bobbin and having axes coincident one to the other, a light source positioned in said cavity in said bed to direct light toward the first of said passageways in said bobbin case, a photodetector means positioned in said cavity with said loop taker intermediate said light source and said photodetector means, said second passageway being between said bobbin and said photodetector means, means for shielding said photodetector means from light other than that transmitted through said first and said second passageways in said bobbin case, a photodetector analyzing means for sensing when light is impinging on said photodetector means, and a signalling means operated by said analyzing means for informing a sewing machine operator of the impending depletion of bobbin thread, said photodetector means, said light source, and said first and said second passageways in said bobbin case being arranged in optical alignment which traverses between said bobbin flanges and exteriorly of said bobbin core, whereby light from the light source can traverse said passageways and impinge on said photodetector means before the bobbin is depleted of bobbin thread.

2. The low bobbin thread detection system as set forth in claim 1 wherein said means for shielding said photodetector means from stray light comprises a shield having an outside wall and an inside wall, said photodetector being mounted a distance behind said inside wall, said shield being immune to the passage of light therethrough but for a first aperture having an axis contained in said outside wall and a second aperture having an axis contained in said inside wall, said axis of said first aperture and said axis of said second aperture aligning one with the other and with the optical axes of said first and said second passageways in said bobbin case wall, whereby light incident on said shield from a direction coincident with said aligned optical axes will impinge on said photodetector means and light incident on said shield from all other directions will be blocked from impinging on said photodetector means.

3. The low bobbin thread detection system as set forth in claim 1, wherein the axis of said first passageway and the axis of said second passageway lie in front of said bobbin core, whereby thread wound around said core poses an optical impediment to the passage of light from said first passageway to said second passageway.

4. The low bobbin thread detection system as set forth in claim 1 wherein said light source is a light emitting diode.

5. The low bobbin thread detection system as set forth in claim 1 further including a means for aligning said photodetector means relative to the axes of said first passageway and said second passageway.

6. The low bobbin thread detection system as set forth in claim 5 wherein said photodetector means and said photodetector analyzing means are mounted on a board having a means integral therewith for aligning said photodetector means relative to the optical axes of said first and said second passageways.

7. The arrangement as set forth in claim 6 wherein said means for aligning said photodetector means relative to the optical axes of said first and second passageways comprises an elongated slot formed in said board and a fastener passing therethrough, said fastener being received in said sewing machine bed.

8. The low bobbin thread detection system as set forth in claim 1 wherein said photodetector analyzing means intermittently operates said signalling means.

9. The low bobbin thread detection system as set forth in claim 1 wherein said signalling means remains turned on after said photodetector means is first illuminated by said light source.

* * * * *